US008302900B2

(12) United States Patent
Gambini

(10) Patent No.: US 8,302,900 B2
(45) **Date of Patent: *Nov. 6, 2012**

(54) REWINDER AND RELATIVE METHOD FOR WINDING PAPER AROUND A CORE FOR MAKING A LOG

(75) Inventor: Giovanni Gambini, Pisa (IT)

(73) Assignee: Gambini International S.A., Luxembourg (LU)

( * ) Notice: Subject to any disclaimer, the term of this patent is extended or adjusted under 35 U.S.C. 154(b) by 238 days.

This patent is subject to a terminal disclaimer.

(21) Appl. No.: 12/695,415

(22) Filed: Jan. 28, 2010

(65) Prior Publication Data

US 2010/0187347 A1 Jul. 29, 2010

(30) Foreign Application Priority Data

Jan. 29, 2009 (IT) ..... MI2009A0103

(51) Int. Cl.
*B65H 18/14* (2006.01)

(52) U.S. Cl. ..... 242/542; 242/532.2; 242/532.3; 242/542.1

(58) Field of Classification Search .... 242/532.2–532.3, 242/542, 542.1
See application file for complete search history.

(56) References Cited

U.S. PATENT DOCUMENTS

| | | | | |
|---|---|---|---|---|
| 5,690,296 | A | 11/1997 | Biagiotti | |
| 5,853,140 | A * | 12/1998 | Biagiotti | 242/534 |
| 5,979,818 | A * | 11/1999 | Perini et al. | 242/521 |
| 6,945,491 | B2 * | 9/2005 | Gambini | 242/521 |
| 7,172,151 | B2 * | 2/2007 | Biagiotti et al. | 242/521 |
| 7,404,529 | B2 * | 7/2008 | Biagiotti et al. | 242/521 |
| 2007/0095967 | A1 * | 5/2007 | Biagiotti et al. | 242/526 |
| 2008/0111017 | A1 * | 5/2008 | Gambini | 242/534 |
| 2008/0272223 | A1 * | 11/2008 | Gambini | 242/521 |
| 2010/0187347 | A1 * | 7/2010 | Gambini | 242/521 |

FOREIGN PATENT DOCUMENTS

| | | |
|---|---|---|
| EP | 0 498 039 | 8/1992 |
| EP | 0 853 060 | 7/1998 |
| WO | 94/21545 | 9/1994 |
| WO | 2007/141818 | 12/2007 |

* cited by examiner

*Primary Examiner* — Sang Kim
(74) *Attorney, Agent, or Firm* — Lucas & Mercanti, LLP

(57) ABSTRACT

A rewinder (10) for winding paper (11') around a core (11) for making a log (11") comprising, in an upstream position, means for transporting and introducing the core (11) into a channel (12) defined at the top by an upper winding roller (14), supplied from above with the paper (11') directed towards the channel (12), and at the bottom by a cradle member (13) associated downstream with a lower winding roller (15), the rewinder (10) comprising a third oscillating roller (16) arranged above the lower winding roller (15).

13 Claims, 5 Drawing Sheets

REWINDER AND RELATIVE METHOD FOR WINDING PAPER AROUND A CORE FOR MAKING A LOG

The present invention refers to an improved rewinder and to a relative method for winding paper around a core for making a log.

In known rewinders for winding paper around a core for making a log, like for example toilet paper for use at home and/or kitchen roll or the like, it is known to use elements that guide the paper entering into the machine and control both its first contact with a new core and the subsequent winding of the paper thereupon in order to make a finished log.

In these machines there are usually some rollers that cooperate with each other in the steps listed above for making the log.

In general, in such known machines there is an upper roller, on which the paper is supplied, and a cradle arranged so as to define, with the upper roller, a channel in which the first contact of the paper with the new cores introduced into the rewinder takes place.

These machines also comprise a second lower roller, which cooperates with the previous upper roller to determine the winding of the paper in a roll in formation with increasing diameter, and a third oscillating roller, arranged above the lower roller, which maintains a certain pressure on the log in formation ensuring that it is correctly wound in a well-compacted manner.

In order to optimise the production of the aforementioned logs, today various devices are known that simultaneously feed a new core into the rewinding machine and expel the finished log from it in a synchronised manner.

In such synchronised steps the paper moving forward on the upper roller is periodically torn by suitable devices so as to identify two edges the downstream one of which is called "final edge" and is wound on the finished log, whereas the upstream one of which is called "initial edge" and is associated with the new core being inserted into the rewinder.

An example of these known machines is described in patent WO94/21545A1 where a device for tearing the paper is shown that takes care of tearing the paper moving forward inside the aforementioned channel, i.e. in a point located between where the core is introduced and where the log is expelled.

Alternatively, other machines are currently on the market in which the devices for tearing the paper take care of tearing the paper moving forward outside of the channel, i.e. in a point upstream of where the core is introduced.

Such a machine is described, for example, in patent EP1262434A1.

In both of the aforementioned two types of rewinding machines the paper tearing device comprises a shaft element, rotating around a pin, and equipped with a paper tearing head that cyclically cooperates with the upper roller to tear the paper that move forward on it towards the channel.

In particular, the tearing of the paper in such machines takes place thanks to two distinct operations of the aforementioned tearing head, which first comes into "contact" with the paper moving forward on the roller and then, through a relative "sliding" of the tearing head itself with respect to the upper roller, pulls the paper taut until it tears.

In order to carry out such steps of contact and relative sliding of the paper moving forward on the upper roller the tearing head in known machines follows a circular trajectory tangent to the upper roller.

According to the above, therefore, during the paper tearing steps a calendering nip is created for the paper defined, indeed, on one side by the upper roller and on the other side by the tearing head.

In such a condition the tearing of the paper takes place thanks to the difference in speed between the upper roller and the tearing head, said difference pulling the paper taut so as to make it tear.

In particular, the tearing takes place along perforation lines made cyclically on the paper upstream of the upper winding roller.

In known machines, therefore, at a given moment, i.e. when a new core is introduced and a finished log is expelled, the tearing head of the shaft, during its circular trajectory, comes into contact tangentially with the paper moving forward on the upper roller and then slows the paper down locally by sliding on the roller so as to pull the paper taut downstream of the head that makes the paper itself tear.

It is clear from what has been stated above that in such machines, where the tearing head rotates at a lower speed than the roller on which the paper moves forward, the tearing of the paper always occurs downstream of the tearing head itself.

Such a paper tearing procedure of known machines thus comprises two distinct steps: the tearing head making contact with the paper moving forward on the roller and the relative sliding of the tearing head itself with respect to the upper roller.

However, the aforementioned tearing procedure has some drawbacks in particular relating to the relative sliding step of the tearing head with respect to the upper roller.

A first drawback derives from the fact that the difference in speed between the tearing head and the upper roller, a difference which indeed generates the relative sliding and the pulling taut of the portion of the paper downstream of the tearing head, is not a constant parameter but depends upon the type of paper used and upon the type of perforation on it made upstream of the upper roller.

In other words, currently each time the type of paper supplied, and/or the type of perforation made on it, is changed, it is necessary to carry out long machines setting operations suitable for modifying the speed of the upper roller and/or of the tearing head to make a correct relative sliding.

These modifications also necessarily alter the amount of logs produced per hour, harming production.

It should also be highlighted that such a difference in speed is not actually simple to identify in view of the fact that the upper roller, in order to keep the paper adhering well while moving forward, is generally always coated with material having high friction coefficient.

In such a case the tearing head must also overcome the friction that the paper produces on the roller making insufficient a difference in speed between tearing head and roller equal to that normally required to generate a maximum tolerable stretching of the paper is it moved forward on a smooth plane.

Another drawback of known rewinders is that the relative sliding step of the tearing head on the roller, suitable for pulling the paper taut by slowing it down locally, has a negative impact upon the quality of the finished log.

Indeed, the aforementioned relative sliding of the tearing head on the roller means that over a time period that is not irrelevant the final edge is necessarily slowed down by the tearing head necessarily creating, upstream of the head itself, an area of accumulation of the paper no longer correctly laid out on the upper roller.

Such accumulation that is created mainly during the relative sliding of the tearing head on the roller, as well as making unwanted ugly folds in the paper, damages the coupling of the core with the initial edge making the latter make first contact with the new core not always laid out ideally and/or laying over other portions of paper.

Such an aspect, disadvantageously, greatly limits the hold of the initial edge on the core determining a rejection.

An excessive accumulation also means irregular perforation spaces of the paper upstream of the roller and thus consequently that the first tears of the finished log are not regularly spaced apart.

The purpose of the present invention is to make an improved rewinder and a relative method for winding paper around a core for making a log capable of solving the aforementioned drawbacks of the prior art in an extremely simple, cost-effective and particularly functional manner.

Another purpose is to make an improved rewinder and a relative method for winding paper around a core for making a log in which the initial edge of paper comes into contact with a new core in an ideal manner.

Yet another purpose is to be able to have an improved rewinder and a relative method for winding paper around a core for making a log in which during the tearing of the paper a minimum accumulation of paper forms at the initial edge.

Yet another purpose is to be able to have an improved rewinder and a relative method for winding paper around a core for making a log in which the tearing of the paper takes place quickly without any relative sliding on the upper winding roller.

Yet another purpose is to be able to have an improved rewinder and a relative method for winding paper around a core for making a log in which the finished log has tearing lines equally spaced apart for the entire length of the paper of the log itself.

These purposes according to the present invention are accomplished by making an improved rewinder and a relative method for winding paper around a core for making a log as respectively outlined in the independent claims.

Further characteristics of the invention are highlighted by the dependent claims.

The characteristics and advantages of an improved rewinder and a relative method for winding paper around a core for making a log according to the present invention shall become clearer from the following description, given as an example and not for limiting purposes, referring to the attached schematic drawings, in which.

Figure 1:
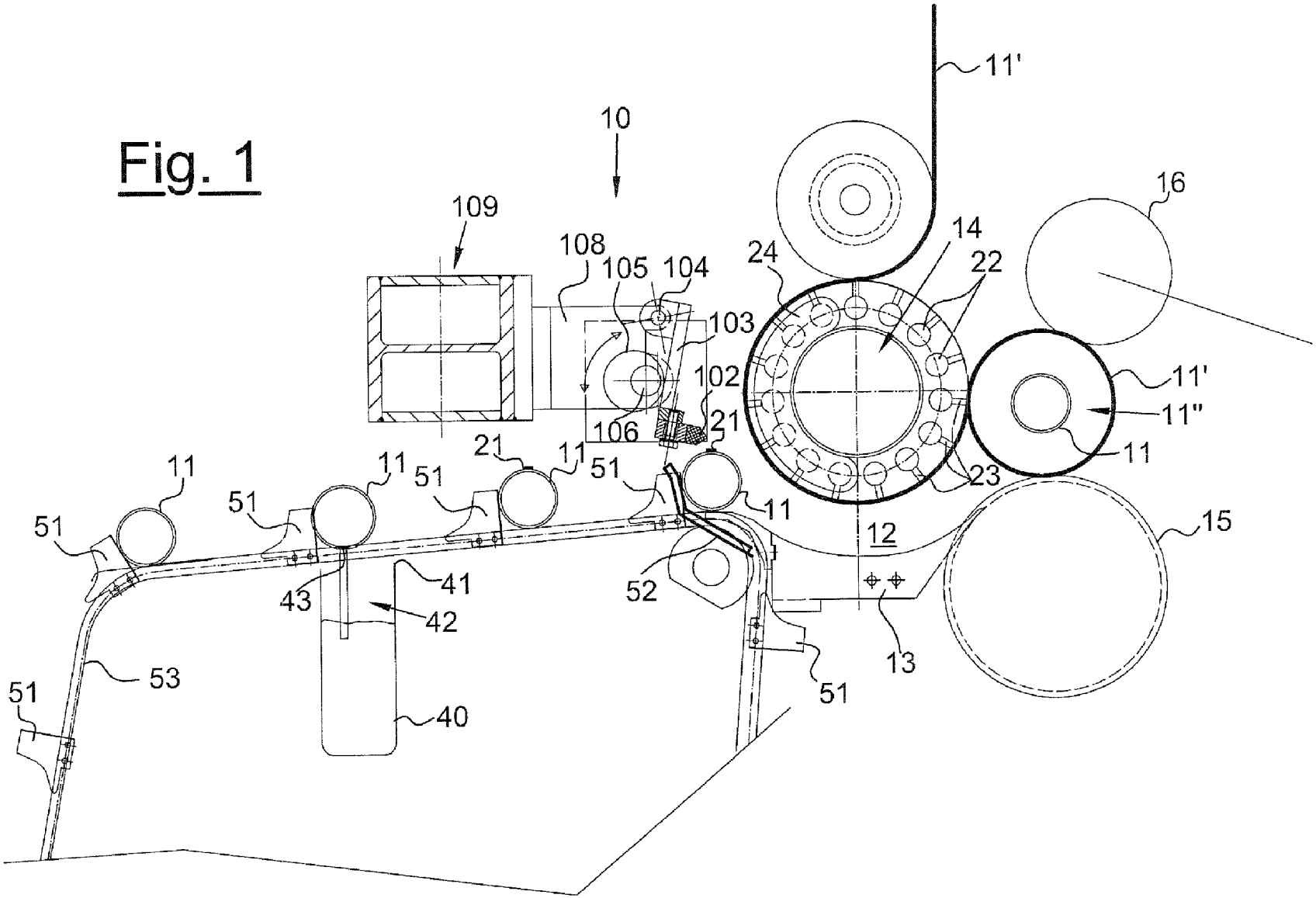
FIG. 1 shows a partial section schematic side elevation view of an improved rewinder for winding paper around a core for making a log according to the present invention in a step of use with the paper winding onto a core already introduced into the machine.

With reference to the figures, an improved rewinder for winding paper 11' around a core 11 for making a log 11" is shown with 10.

Such a rewinder 10 comprises, in an upstream position, means for transporting and introducing a succession of cores 11 one after the other into a channel 12 that, as can be seen in FIGS. 1-4, is defined at the top by an upper winding roller 14, supplied from above with the paper 11' towards the channel 12 itself, and at the bottom by a cradle member 13.

There is also a lower winding roller 15, associated downstream of the cradle member 13, and a third oscillating roller 16 arranged above the lower winding roller 15.

These three rollers 14, 15, 16 have axes that are parallel to one another and perpendicular to the forward movement of the paper 11' and they cooperate with one another downstream of the channel 12 to wind the paper 11' around the core 11 to make the finished log 11".

In order to tear the paper 11' to identify a final edge 50, which must be wound on the finished log 11", and an initial edge 60, which must be coupled with a new core introduced into the channel 12, there are cyclical tearing means of the paper 11' moving forward on the upper winding roller 14.

In order to ensure the coupling of the initial edge 60 on the new core 11 introduced into the channel there are also means for causing such an initial edge 60 to wind onto the core 11.

For cyclical tearing means of the paper 11', synchronised with the supply of a new core and the expulsion of a finished log 11", it is foreseen for there to be at least one tearing head 102 cyclically mobile with alternate motion, preferably oscillating, between a first inoperative position, distant from the upper winding roller 14, and a second operative position in contact with the paper 11' moving forward on the upper winding roller 14.

In particular, therefore, the tearing head 102 divides the paper 11' moving forward on the upper winding roller 14 generating the final edge 50 that must be wound on the finished log 11" and the initial edge 60 to be coupled with the new core 11.

According to the invention the tearing head 102 does not make a rotary movement but an alternate movement between a bottom dead centre, first inoperative position distant from the roller 14, and a top dead centre, second operative position in contact with the paper 11' moving forward on the roller 14.

Moreover, according to the invention the contact of the tearing head 102 and the paper 11' moving forward on the roller 14 takes place without the tearing head 102 transmitting any relative sliding to the paper 11' with respect to its forward movement on the roller 14.

In this way the cooperation of the tearing head 102 and of the upper winding roller 14 is small and substantially limited to the instantaneous contact step, in which the paper is substantially blocked and thus almost instantly torn.

In this way according to the invention, since the tearing of the paper is carried out extremely quickly, the accumulation of paper upstream of the tearing head 102 is reduced to the minimum and such as not to have a negative influence upon either the first contact of the initial edge on the new core 11 or on the perforation spaces of the paper 11' upstream of the roller 14.

Indeed, in the prior art the accumulation of paper is substantially due to the "long" cooperation time of the tearing means with the upper roller.

According to the invention the approach and separation trajectory of the at least one tearing head 102 with respect to the upper winding roller 14 has at least one non-zero perpendicular component with respect to the forward movement of the paper 11' on the upper winding roller 14 so as to avoid transmitting to the paper relative sliding with respect to the roller 14 on which it moves forward.

Preferably, the approach and separation trajectory of the at least one tearing head 102 with respect to the upper winding roller 14 is substantially perpendicular to the forward movement of the paper 11' on the upper winding roller 14.

In this way the tearing of the paper 11' takes place almost instantly due to a strong pulling taut induced by the instantaneous contact, without sliding, by the tearing head 102 that strikes, preferably perpendicularly, against the upper winding roller 14.

Alternatively, the approach and separation trajectory of the at least one tearing head 102 with respect to the upper winding roller 14 may also not be strictly perpendicular to the forward movement of the paper 11' but inclined so as to identify a maximum angle of about ±20°, preferably ±10°, with respect to the normal to the upper winding roller 14 in the point of relative contact.

In this last case, the tearing of the paper 11' takes place almost instantly due to a strong pulling taut induced by the non-zero perpendicular component of the approach and separation trajectory of the at least one tearing head 102 with respect to the forward movement of the paper 11'.

Indeed, the presence of such a non-zero perpendicular component of the approach and separation trajectory of the at least one tearing head 102 with respect to the forward movement of the paper 11' avoids there being sliding of the head itself 102 with respect to the upper winding roller 14 thus instantly tearing the paper 11'.

According to the embodiment shown, the tearing means comprise at least one support element 103 provided with a first end, for example lower, associated with the at least one tearing head 102 and with a hinged second end 104, for example upper.

Associated with such an at least one support element 103, which preferably according to what has been outlined above is like a pendulum element, there are actuator means capable of generating an alternating cyclical oscillation of the support element 103 itself around the second hinged end 104.

In this way the support 103 completes a truly pendulum-type alternate movement.

Figure 5:
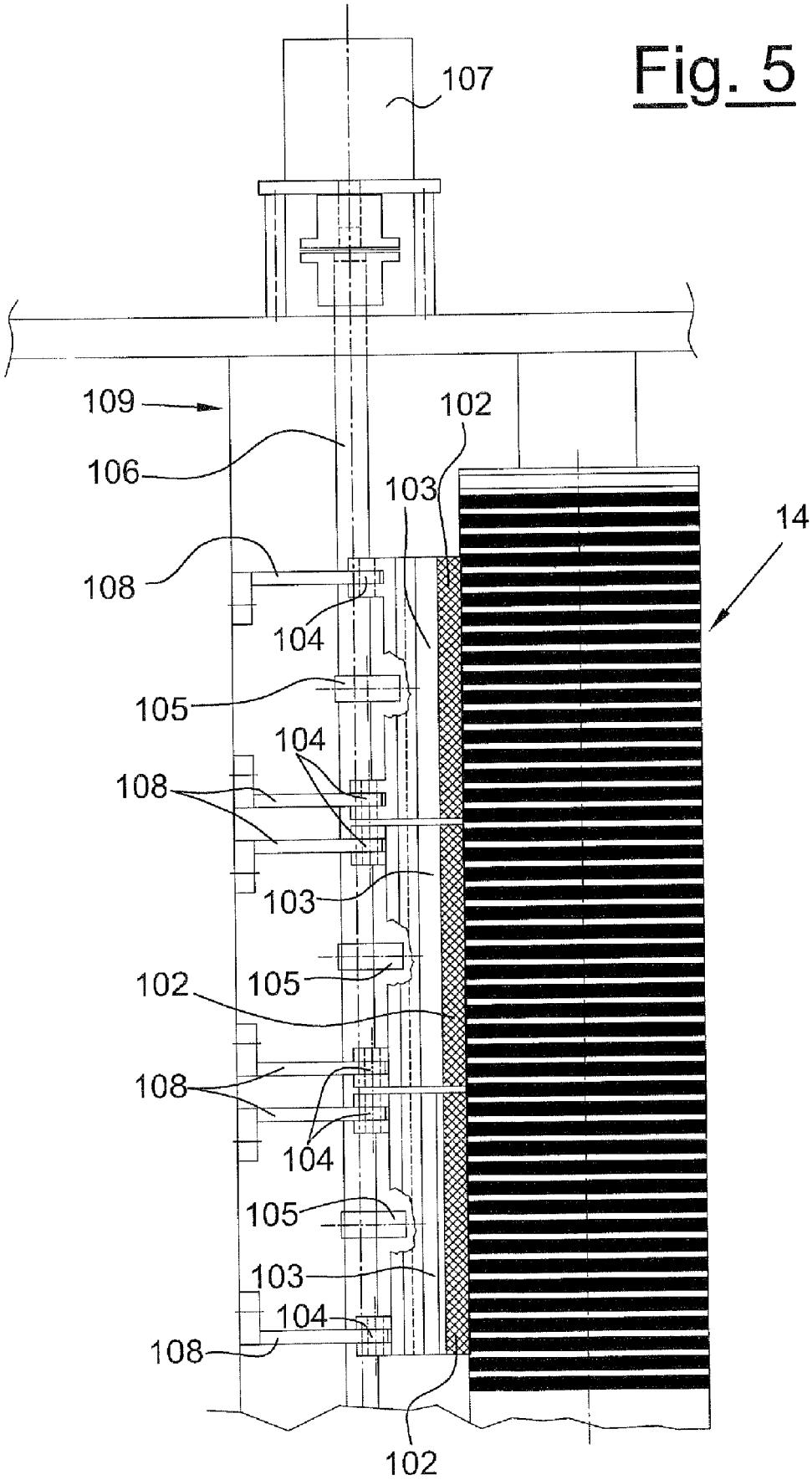
FIG. 5 is a partial section schematic view from above of some elements of the rewinder for winding paper around a core to make a log according to the present invention.

For the actuator means it is possible to foresee at least one cam 105 mounted on a shaft 106 associated with the at least one support 103 on the opposite side with respect to the upper winding roller 14 and set in rotation by a suitable motorisation 107 shown in FIG. 5.

Such an at least one cam 105 transmits the alternating cyclical oscillation to the at least one support element 103 around its second hinged end 104.

How such an at least one cam 105 acts against the relative support 103 is shown in FIGS. 1-4.

In the first inoperative position of the tearing head 102, FIG. 1, the cam 105, consisting of a disc 105 mounted eccentrically on the shaft 106, is oriented the opposite way with respect to the upper winding roller 14 and the support 103 is pulled back and kept in such a position by return means, such as springs, not shown.

Alternatively, according to a different embodiment, not shown, it is also possible to foresee different types of actuators such as a slotted link or other.

Figure 2:
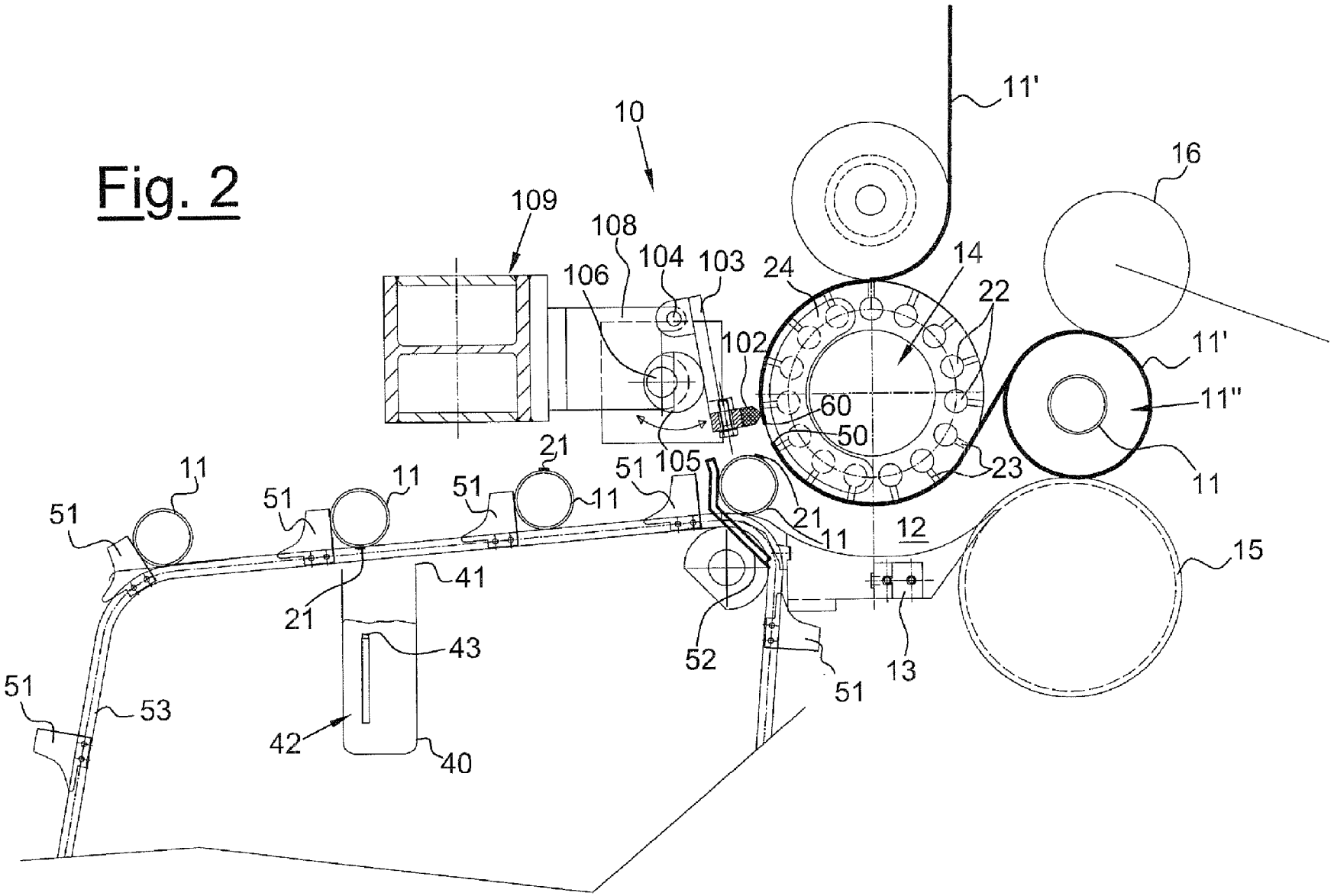
FIG. 2 shows a partial section schematic side elevation view of the rewinder of FIG. 1 in a subsequent step of use at the tearing of the paper and the introduction of a new core into the machine.

In the second operative position of the tearing head 102, FIG. 2, the cam 105 is oriented towards the upper winding roller 14 and pushes the tearing head 102 against the upper winding roller 14 overcoming the return forces acting upon the tearing head 102 itself.

In such a position the tearing head 102 strikes, preferably perpendicularly and in any case with a non-zero perpendicular component with respect to the upper winding roller 14, against the paper 11' moving forward on the upper winding roller 14 pulling it taut almost instantly until it tears.

Figure 3:
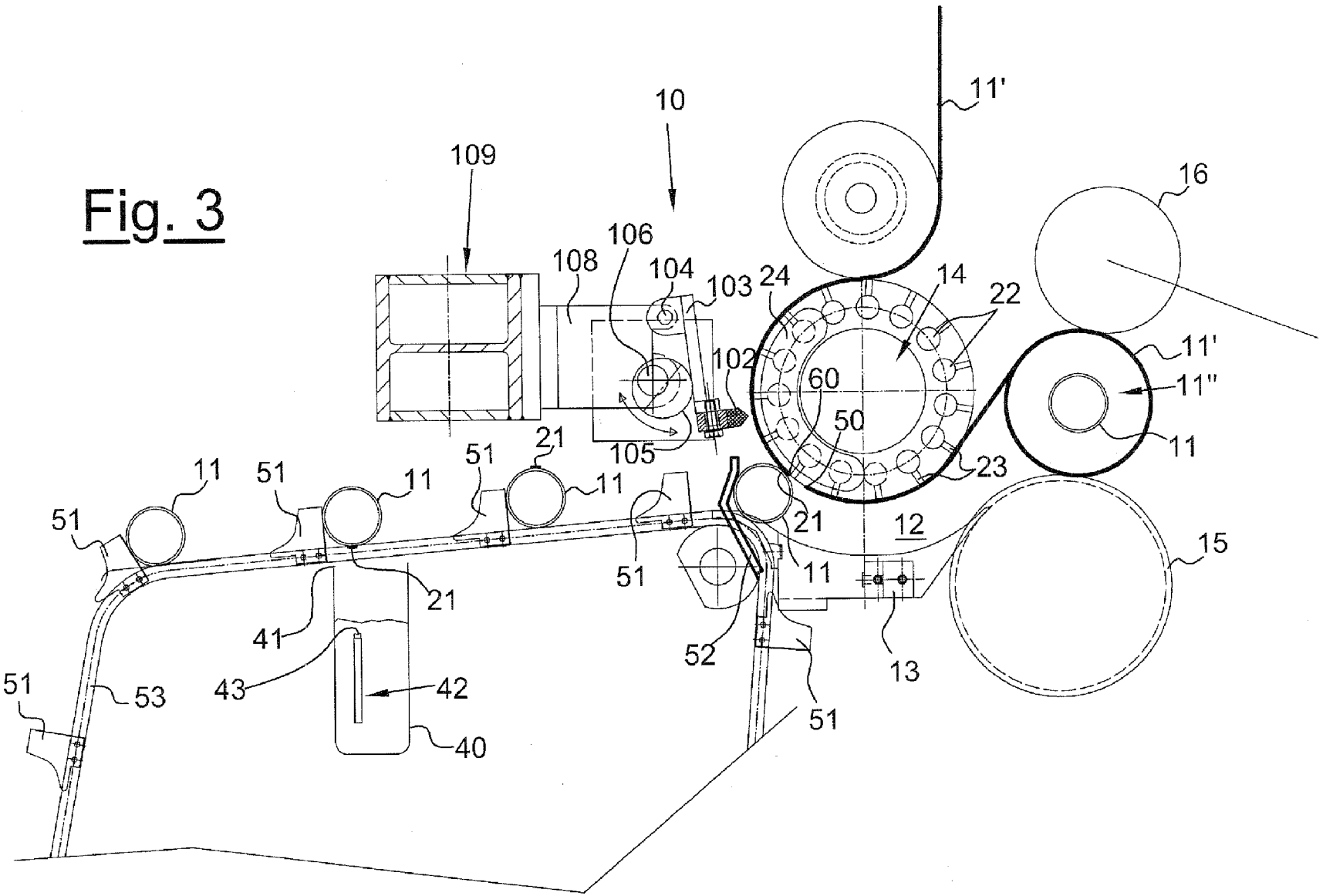
FIG. 3 shows a partial section schematic side elevation view of the rewinder of FIG. 1 in a subsequent step of use at the coupling of the initial edge with the new core introduced into the machine.
Figure 4:
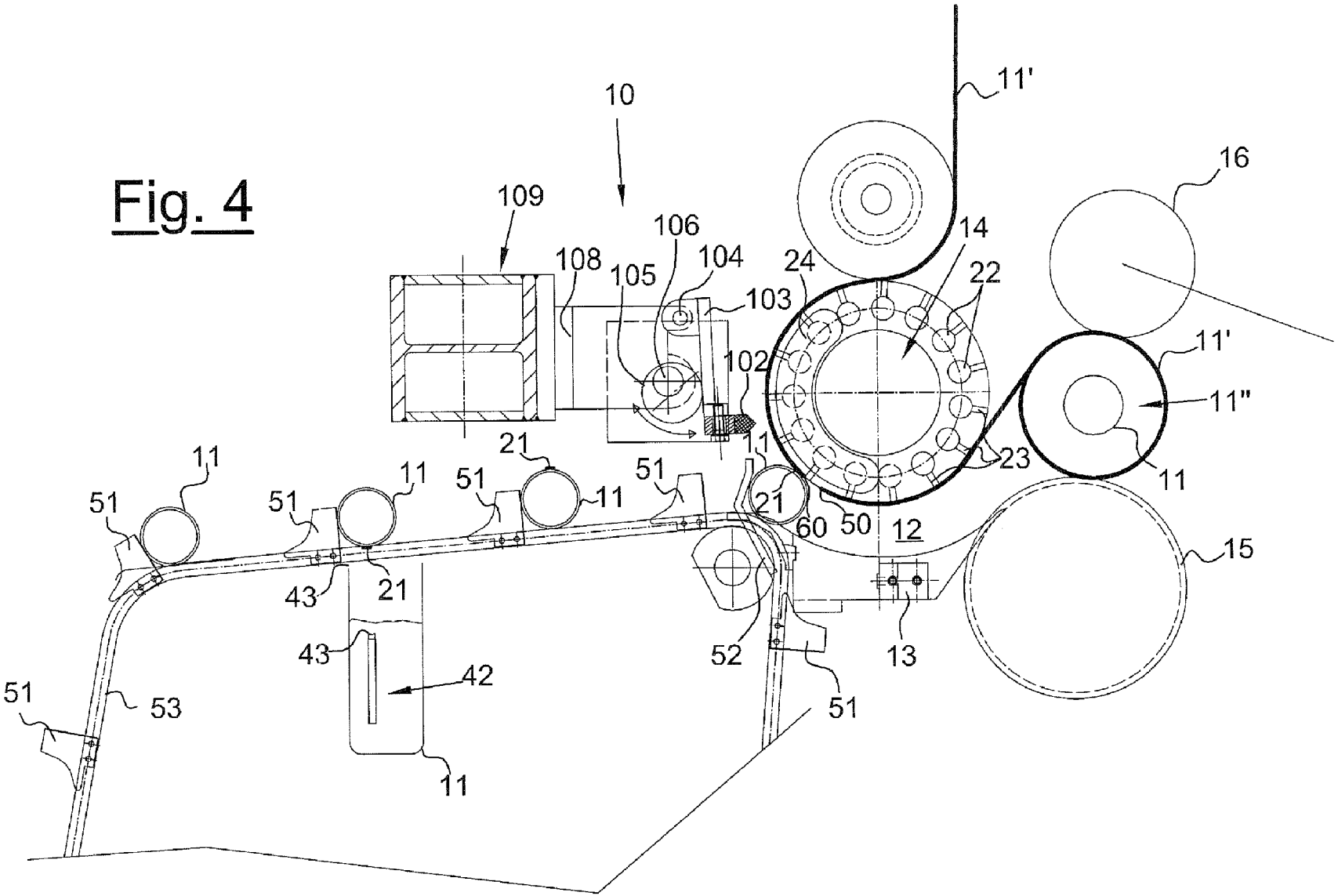
FIG. 4 shows a partial section schematic side elevation view of the rewinder of FIG. 1 in a subsequent step of use at the winding of the paper onto the new core introduced into the machine that has received the initial edge.

An instant after such striking, the cam 105 rotates further and orients itself downwards, FIGS. 3 and 4, in an intermediate position between the two described previous ones, allowing the return means to quickly separate the tearing head 102 from the upper winding roller 14.

Thus since the striking and the release of the tearing head 102 occur almost instantly, there in a minimum accumulation of paper according to an amount not having a negative influence upon the quality of the finished log.

As shown in FIG. 5, the tearing means in particular can comprise a plurality of tearing heads 102, preferably point-shaped and made from rubber material, each associated with a relative cam 105, in which all of the cams 105 are associated with a common shaft 106.

According to what can be seen in FIG. 5, the tearing heads 102 are alongside one another along the entire length of the upper roller 14 and connected with brackets 108 to a common base 109.

Preferably, the tearing heads 102 have a plurality of grooves regularly spaced along the direction parallel to the extension of the upper roller 14.

In particular, such grooves are formed on the tearing heads 102 in positions such as to avoid the tearing heads 102 themselves coming into contact with tungsten carbide rings present on the outer surface of the upper roller 14 and suitable for holding the paper 11' moving forward.

Indeed, a possible contact of the tearing heads 102 with such tungsten carbide rings could cause undesired tearing of the paper 11'.

In FIG. 2 it is possible to see both the final edge 50, which must be wound onto the log 11", and the initial edge 60.

As can be seen, both stay laid out without folds on the upper winding roller 14 respectively downstream and upstream of the tearing head 102 since it generates a minimal accumulation of paper 11'.

Advantageously, in this way, since the initial edge 60 is laid out on the upper winding roller 14 without folds, it is guaranteed that there is a correct coupling of the initial edge 60 itself with the new core 11 supplied into the channel 12.

How such a coupling takes place without the generation of any folds is shown in FIG. 3.

According to the preferred embodiment, shown in FIGS. 1-4, the cyclical tearing means of the paper 11' are arranged upstream of the channel 12 and upstream of the means for transporting and introducing the cores 11 and cooperate with means for keeping the paper 11' adhering around the upper winding roller 14 acting at least upstream of the channel 12.

Preferably, such means for holding the paper 11' act both along a section upstream and downstream of the cyclical tearing means to keep both the initial edge 60 and the final edge 50 adhering around the upper winding roller 14.

In order to take care of keeping the edges 50 and 60 on the upper winding roller 14, the latter can comprise a plurality of longitudinal channels 22 arranged according to a circular crown near to its cylindrical outer side surface.

Such longitudinal channels 22 pass from one head to the other head of the upper winding roller 14 and each of them is placed in communication with the outside on the cylindrical outer side surface of the upper winding roller 14 through a plurality of holes 23.

Cooperating with such longitudinal channels 22 there is a pair of suctioning shoes 24, for example, the form of a circular sector, arranged in axis with the roller 14 and fixed facing the opposite heads.

The suctioning shoes 24 are adapted to cause suctioning of air through the channels 22 located between them from the outside towards the inside of the upper winding roller 14.

Thus, to ensure that both the initial edge 60 and the final edge 50 adhere around the upper winding roller 14 during its forward movement, the aforementioned suctioning shoes 24 extend on the heads of the upper winding roller 14 both above and beneath the point of cyclic contact of the head 102 with the cylindrical outer surface of the roller 14 itself. In the shown example the shoes 24 extend for a sector of about 180°.

The suction through the shoes 24 can be continuous or suitably synchronised with the operation of the rewinder 10 and ensures the transportation of the initial edge 60 adhering to the shell of the roller in the fraction that runs between the tearing of the paper and the insertion of the new core into the channel 12.

The core 11, inserted in the channel 12 in which it is supported by the cradle member 13, receives the initial edge 60 of the paper 11', which, staying adhering without creases to the surface of the suctioned roller 14 during the rotation thereof, makes such a coupling optimised.

Indeed, the suctioned surface of the upper roller 14 avoids the initial edge 60 of the paper 11' going back.

At the inlet of the channel 12 it is possible to foresee for there to be a pushing element 52 rotating around a pin to insert the cores 11 in the channel 12 at the discharge of the finished log 11" and at the start of a new log to be formed.

Of course, other types of oscillating or rotating pushing elements, different to what has been shown as a non-limiting example could be arranged at the inlet of the channel 12.

In such a rewinder 10, as stated earlier, in order to ensure the correct coupling in the channel 12 of the initial edge 60 of the paper 11' with the new core 11, it is possible to foresee means for causing the aforementioned initial edge 60 to wind onto the core 11 introduced into the channel 12.

In an embodiment shown in FIGS. 1-4 the aforementioned means for causing winding comprise means for supplying glue 21 onto the core 11 arranged upstream of the channel.

As can be imagined, such glue 21 during the journey of the core 11 in the channel 12 holds the initial edge 60, which proceeds on the roller 14 thanks to the suctioning means, ensuring a secure winding of the paper 11'.

Alternatively, according to an embodiment that is not shown, the means for causing the initial edge 60 to wind onto the core 11 introduced into the channel 12 can comprise means for separating the initial edge 60 from the upper winding roller 14 arranged at the channel 12 substantially downstream of the cyclical means for tearing said paper 11' and of the suctioning shoes 24.

In particular, such means for separating the initial edge 60 have the purpose of pushing the initial edge 60 of the paper 11' towards the lower portion of the channel 12 promoting its firm engagement on the new core 11 that is moving forward in the channel 12 trapping the paper 11' between the core 11 moving forward and the cradle 13.

The core 11, inserted into the channel 12 in which it is supported by the cradle 13, receives and then holds, as can be seen in FIG. 4, the initial edge 60 of the paper 11' which, being located between the surface of the core 11 during the rotation thereof and the cradle 13, naturally winds onto the core 11.

The means for separating the initial edge 60 from the upper winding roller 14 can be of whatever type, for example mechanical such as cams, or, according to a preferred embodiment that is not shown, they can comprise a pair of circular sector shaped shoes arranged in axis with the roller 14 facing opposite heads at the channel 12 substantially downstream of the cyclical tearing means of the paper 11'.

Such shoes are adapted to cause air to come out through the channels 22 located between them and to push the initial edge 60 of the paper 11' downwards into a position located between the core 11 moving forward and the cradle 13.

As described in such a last embodiment with the blowing shoes downstream of the suctioning shoes 24, it is not necessary for there to be glue 21 on the core 11 moving forward in the channel 12, but nevertheless the presence of glue 21 also in such an embodiment does not harm the correct operation of the rewinder 10.

With regard to the dispenser of glue 21 onto the core upstream of the channel 12, it preferably can comprise means for depositing glue onto at least one outer portion of the core 11.

Preferably, the glue can be deposited in the form of a plurality of circle arcs so as not to require particularly precise phasing of the core itself 11 when introduced into the channel 12.

Indeed, since the glue 21 is distributed along a circle arc, almost irrespective of its position on the core 11 upon introduction of the channel 12 it will make sure that it meets and securely holds the initial edge 60 of the paper 11'.

In the case in which it is however wished to phase the core 11 provided with glue 21, the rewinder 10 can comprise an upper abutment plane that extends at least partially from the means for supplying glue towards the channel 12 above the means for transporting and introducing the core 11 and knurled lower phasing elements.

Such an upper abutment plane and such knurled elements transmit a controlled rotation to the core 11 after glue 21 has been dispensed to arrange the latter in an optimal position for immediately receiving the initial edge 60 as soon as the core 11 is inserted into the channel 12.

In particular, the means for supplying glue onto the core 11 comprise a container 40 for the glue equipped with an opening 41 oriented upwards and associated with the means for transporting and introducing the core 11 into the channel 12.

In such a container 40 a member 42 is housed that is mobile between a first position for receiving the glue by immersion and a second position for dispensing the glue received onto the core 11 moving forward on the means for transporting and introducing.

Such a mobile member comprises a plurality of free heads 43, preferably shaped like a convex circle arc, in which each free head 43 in the first receiving position is immersed in the glue and in the second dispensing position projects from the opening 41 towards the core 11 as schematised in FIG. 1.

The transporting means can, for example, comprise a plurality of chains 53 each equipped with pushing elements 51.

It is absolutely easy to understand how the improved rewinder for winding paper around a core for making a log object of the invention operates.

Indeed, the improved rewinder 10 for winding paper 11' around a core 11 for making a log 11" cyclically carries out the steps of:

a) transporting and introducing the core 11 into a channel 12 defined at the top by an upper, winding roller 14 and at the bottom by, a cradle member 13 associated, in a downstream position, with a lower winding roller 15;

b) supplying the paper 11' from above onto the upper winding roller 14 towards the channel 12;

c) cyclically tearing the paper 11' moving forward on the upper winding roller 14 upon introduction of the core 11 into the channel 12 to identify an initial edge 60 to be coupled with the new core 11 introduced into the channel 12;

d) winding the initial edge 60 of the paper 11' around the core 11 to make a log 11" downstream of the channel 12 through cooperation of the upper and lower winding rollers 14, 15 with a third oscillating roller 16 arranged above the lower winding roller 15, in which the step of tearing the paper 11' moving forward on the upper winding roller 14 to identify an initial edge 60 to be coupled with the new core 11 introduced into the channel 12 comprises the steps of:

e) bringing at least one tearing head 102 into contact with the paper 11' moving forward on the roller 14 in an alternate oscillating cyclical manner.

According to the invention, during the step of tearing the paper moving forward on the upper winding roller 14, the tearing head 102 comes into contact with the paper 11' moving forward on the upper winding roller 14 in a position upstream of the channel 12 and upstream of the means for transporting and introducing the cores 11.

Preferably, a head 102 in such a step of contact with the paper 11' moving forward on the roller 14 carries out an approach and separation trajectory substantially perpendicular or in any case with a non-zero perpendicular component with respect to the forward movement of the paper 11' roller 14 without pulling it taut in any way.

In particular, the approach and separation trajectory of the at least one tearing head 102 with respect to the upper winding roller 14 is preferably perpendicular.

Alternatively, such a trajectory can be inclined so as to identify a maximum angle of about ±20°, preferably ±10°, with respect to the normal to the upper winding roller 14 in the point of contact with the at least one tearing head 102.

In the case in which it is foreseen to deposit glue 21 on the core 11 naturally it is also foreseen for there to be the steps of depositing glue 21, preferably in the form of a circle arc, on an outer portion of the core 11 and, possibly, transporting such a core 11 provided with glue 21 in a controlled manner up to the channel 12.

It has thus been seen that an improved rewinder and a relative method for winding paper around a core for making a log according to the present invention achieves the purposes highlighted earlier.

Indeed, in the improved rewinder for winding paper around a core for making a log the "initial edge" of paper makes contact with a new core in an ideal manner thanks to the fact that the tearing of the paper occurs quickly and thus with a minimum formation of any accumulation of paper at the initial edge not having a negative influence upon the quality of the finished log.

In this way, the improved rewinder allows a finished log to be made in which the tearing lines are equally spaced for the entire length of the paper of the log itself.

The improved rewinder and the relative method for winding paper around a core for making a log of the present invention thus conceived can undergo numerous modification and variants, all of which are covered by the same inventive concept; moreover, all of the details can be replaced with technically equivalent elements. In practice, the materials used, as well as their sizes, can be whatever according to the technical requirements.

The invention claimed is:

1. A rewinder for winding paper around a core for making a log, comprising:

an upper winding roller;

a lower winding roller;

a cradle associated with said lower winding roller;

a channel defined at a top by said upper winding roller, which is supplied from above with said paper directed towards said channel, and at a bottom by said cradle member associated downstream with said lower winding roller;

means for transporting and introducing said core into said channel;

means to cause said initial edge to wind on said core introduced into said channel;

a third oscillating roller arranged above said lower winding roller, said upper winding roller, said lower winding roller and said third oscillating roller having axes parallel to each other and perpendicular to a forward movement of said paper and cooperating downstream of said channel to wind said paper around said core to make said log; and tearing means for tearing said paper moving forward on said upper winding roller to identify a final edge and an initial edge, wherein said tearing means comprise comprises at least one tearing head, which is cyclically mobile and alternates between a first inoperative position distant from said upper winding roller and a second operative position in contact with said paper moving forward on said upper winding roller, said second operative position being substantially instantaneous and without sliding along said upper winding roller, and wherein, at said second operative position, an approach, contact and separation trajectory of said at least one tearing head with respect to said upper winding roller, said at least one tearing head defines a maximum angle of about ±20° perpendicular to the forward movement of said paper on said upper winding roller.

2. The rewinder according to claim 1, wherein, at said second operative tearing position, the approach, contact and separation trajectory of said at least one tearing head with respect to said upper winding roller is substantially perpendicular to the forward movement of said paper on said upper winding roller.

3. The rewinder according to claim 1, wherein said tearing means comprises at least one support element having a first end associated with said at least one tearing head and a second hinged end having means for actuating an alternating cyclical oscillation of said support element around said second hinged end.

4. The rewinder according to claim 3, wherein said means for actuating said alternating cyclical oscillation of said at least one support element around said second hinged end comprises at least one cam mounted on a shaft, said cam transmitting said alternating cyclical oscillation during the rotation of said shaft.

5. The rewinder according to claim 4, wherein said means for actuating said alternating cyclical oscillation of said at least one support element around said second hinged end comprises a plurality of support elements having said tearing heads, said plurality of support elements extending along an entire length of said upper winding roller.

6. The rewinder according to claim 5, wherein said support elements are connected through said second hinged ends to a bracket structure, which is in turn connected to a common base.

7. The rewinder according to claim 5, wherein said tearing heads comprise a plurality of grooves regularly spaced in a direction parallel to an extension of said upper roller, said grooves being positioned at tungsten carbide rings formed on the outer surface of said upper roller for holding said paper.

8. The rewinder according to claim 1, further comprising means for keeping said paper adhering to said upper winding roller at least upstream of said channel, said cyclical tearing means being arranged upstream of said channel and upstream of said means for transporting and introducing said cores.

9. The rewinder according to claim 1, wherein said upper winding roller comprises a plurality of longitudinal channels arranged according to a circular crown near to a cylindrical outer surface of said roller, each of said longitudinal channels being in communication with an outside through a plurality of holes formed on the cylindrical outer surface of said roller, a pair of suctioning shoes being arranged in axis with said roller fixed and facing opposite heads, said suctioning shoes being adapted to cause suctioning of air through the channels located between said suction shoes and extended on said heads of said upper winding roller both above and beneath a point of cyclic contact of said head with said paper moving forward on said upper winding roller.

10. The rewinder according to claim 1, wherein said means to cause said initial edge to wind on said core introduced into said channel comprise means for supplying glue on said core upstream of said channel.

11. A method for winding paper around a core to make a log cyclically, the method comprising the steps of:

a) transporting and introducing said core into a channel defined at a top by an upper winding roller and at a bottom by a cradle member associated downstream with a lower winding roller;

b) feeding said paper from above onto said upper winding roller towards said channel;

c) tearing said paper moving forward on said upper winding roller upon introduction of said core in said channel;

d) coupling and winding said paper around said core to make said log downstream of said channel through cooperation of said upper and lower winding rollers with a third oscillating roller arranged above said lower winding roller, wherein said step of tearing said paper moving forward on said upper winding roller upon introduction of said core in said channel comprises the steps of:

e) bringing a tearing head in contact with said paper moving forward on said upper winding roller through alternating cyclical substantially instantaneous movement making contact and then moving apart without sliding with respect to said upper winding roller, and f) wherein said tearing head, at said upper winding roller, follows an approach, contact and separation trajectory that defines a maximum angle of about ±20° with respect to the perpendicular to the forward movement of said paper on said upper winding roller.

12. The method according to claim 11, wherein said tearing head, at said upper winding roller, follows an approach, contact and separation trajectory substantially perpendicular to the forward movement of said paper on said abutment element.

13. The method according to claim 11, wherein during said step of tearing the paper moving forward on the upper winding roller the tearing head comes into contact with the paper moving forward on the upper winding roller in a position upstream of the channel and upstream of the means for transporting and introducing the cores.

* * * * *